US011391086B2

(12) United States Patent
Webb et al.

(10) Patent No.: US 11,391,086 B2
(45) Date of Patent: Jul. 19, 2022

(54) METHOD OF USING AND DISTRIBUTING A WEATHER SEAL ASSEMBLY FOR AN OVERHEAD DOOR

(71) Applicant: National Door Industries, Inc., Fort Worth, TX (US)

(72) Inventors: James Patrick Webb, Arlington, TX (US); Jorge Manuel Prieto, Fort Worth, TX (US)

(73) Assignee: National Door Industries, Inc., Fort Worth, TX (US)

( * ) Notice: Subject to any disclaimer, the term of this patent is extended or adjusted under 35 U.S.C. 154(b) by 0 days.

(21) Appl. No.: 17/029,325

(22) Filed: Sep. 23, 2020

(65) Prior Publication Data

US 2021/0102425 A1 Apr. 8, 2021

Related U.S. Application Data

(60) Provisional application No. 62/909,521, filed on Oct. 2, 2019.

(51) Int. Cl.
*E06B 7/23* (2006.01)
*E06B 3/48* (2006.01)

(52) U.S. Cl.
CPC ..... *E06B 7/2303* (2013.01); *E06B 3/485* (2013.01); *E06B 7/2316* (2013.01); *E05Y 2900/106* (2013.01)

(58) Field of Classification Search
CPC ..... E06B 7/2303; E06B 7/2316; E06B 3/485; E06B 3/9643
USPC ..... 49/482.1
See application file for complete search history.

(56) References Cited

U.S. PATENT DOCUMENTS 2,934,802 A * 5/1960 Shekter ..... E06B 7/2316 49/493.1
3,324,598 A * 6/1967 Tinfow ..... E06B 7/2316 49/482.1
3,468,369 A * 9/1969 Tetrick et al. ..... F25B 25/005 165/63
4,497,236 A 2/1985 Khallil
4,646,905 A 3/1987 Grundken et al.
5,124,511 A * 6/1992 Miller ..... E05F 15/42 200/61.43
5,327,680 A * 7/1994 Miller ..... E05F 15/42 49/27
5,365,993 A 11/1994 Jella
5,839,227 A * 11/1998 Gardner ..... 49/27
6,484,447 B1 11/2002 Snyder et al.
(Continued)

*Primary Examiner* — Gregory J Strimbu
(74) *Attorney, Agent, or Firm* — Whitaker Chalk Swindle & Schwartz PLLC; Charles Gunter

(57) ABSTRACT

A knock-down seal assembly for an overhead-sectional door having horizontal joints between adjacent panels and a leading lateral edge that seals the lateral leading edge of the door as the door closes against the floor or traffic area. The seal assembly includes a pair of retainer rails which do not exceed about 6 feet in overall length. Each of the retainer rails has seal channels formed so as to extend from a bottom surface thereof for receiving a flexible weather seal strip. Each of the rails also has an extension channel formed so as to extend from the bottom surface thereof for receiving an elongate retainer clip. The retainer clip can be used to join the pair of retainer rails to form a single rail.

6 Claims, 5 Drawing Sheets

(56) References Cited

U.S. PATENT DOCUMENTS

| | | | | |
|---|---|---|---|---|
| 6,598,349 | B1 * | 7/2003 | Balbaugh | E06B 7/16 49/475.1 |
| 6,622,431 | B1 | 9/2003 | Simons | |
| 8,984,813 | B2 * | 3/2015 | Vulpitta | E06B 7/2316 49/470 |
| 10,000,958 | B2 * | 6/2018 | Evans | E06B 9/88 |
| 10,113,357 | B2 * | 10/2018 | Gillen | E06B 7/231 |
| 10,704,321 | B2 * | 7/2020 | Ohrstrom | E06B 7/2312 |
| 2005/0086868 | A1 * | 4/2005 | Santelli | E06B 7/2305 49/499.1 |
| 2012/0079771 | A1 | 4/2012 | Meulemans | |
| 2018/0163459 | A1 * | 6/2018 | Mathieu | E06B 7/2316 |

* cited by examiner

METHOD OF USING AND DISTRIBUTING A WEATHER SEAL ASSEMBLY FOR AN OVERHEAD DOOR

CROSS-REFERENCE TO RELATED APPLICATION

The present application claims priority to U.S. Provisional Patent Application Ser. No. 62/909,521 filed Oct. 2, 2019, by the same inventors and with the same title.

1. Field of the Invention

The present invention relates to overhead sectional doors, such as garage doors, and more particularly to the bottom weather seal used for such overhead doors.

2. Description of the Prior Art

Garages, warehouses and other similar structures are often fitted with overhead sectional doors. A sectional door typically includes a series of panels that are pivotally interconnected at horizontal joints. As the door opens or closes, the door panels travel along two lateral tracks that, in one configuration, curve between horizontal and vertical. To close the door, the tracks guide the panels to a vertical position. When the door opens, the pivotal joints allow the panels to curve around onto the horizontal section of the tracks, where the door panels store horizontally overhead. Such doors can be powered up or down, or can be manually operated. To ease the operation of the door, a torsion spring is often used to offset the weight of the door panels. Overhead doors of the type under consideration are commonly used as a residential garage door but are also often used in warehouses and other industrial buildings. In the discussion which follows, the term "overhead door" will be understood to mean the common overhead garage door, but also is intended to encompass the other uses of such overhead doors, such as warehouse doors, and the like.

Garage doors of the type described are thus opened and closed by raising and lowering them within a wall opening of an associated building or structure. When closed, the bottom of the door is typically brought into direct contact with the garage floor or a threshold. These types of doors usually include a bottom seal that engages the garage floor or the threshold when the door is lowered. The bottom seal helps to seal the garage from the environment, keeping out rain, wind, cold, insects, and the like. The seal also makes the door level to the ground when closed. The bottom seal is commonly made of rubber, a suitable plastic, or other material having the requisite properties to serve as a sealing element.

Conventional garage door bottom seals are secured to the bottom of the door in a number of ways. For example, some garage doors are provided with a channel or a pair of channels at the bottom of the door to receive the seal. The channels may be formed in an extruded metal or plastic rail, referred to as a "retainer rail" herein, which is disposed at the bottom of the door. The retainer rail with its associated weather seal can be fastened to the bottom of the door in any convenient manner, for example, using screws or adhesives. The bottom seal is typically sized to match the length of the garage door. In some cases, the seal is flexible along its length and is provided in a roll. In such case, the seal can be unrolled and cut to length at the time of installation. In other cases, the seal is rigid and may be pre-cut to match the length of the door.

The retainer rail for the weather seal is commonly extruded, as from aluminum or a suitable plastic, in lengths varying from about 5 feet to 18 or 20 feet, or even longer. A garage door for a typical garage might be, for example, 16 feet in width. However, shipping long extruded strips of material, such as the material used for the retainer rail, is expensive and the long rails may be easily damaged in shipment and handling. Smaller length strips, for example 5 to 6 feet lengths, can be shipped by commercial carrier at no additional add-on cost since they are not considered oversized goods.

Thus, while the roll seal material itself can be cut to length at the jobsite, the extruded retainer rails continue to be shipped in the longer lengths. There thus exists a need for a bottom weather seal assembly which would be provided as a "knock-down" assembly, whereby the seal assembly could be shipped in shorter lengths which would then be assembled at the time of use into a longer overall strip.

SUMMARY OF THE INVENTION

A knock-down weather seal assembly and assembly technique are shown for installing a weather seal on a sectional overhead door having a series of hinged horizontal sections and a bottom lateral edge. The knock-down seal assembly includes at least two extruded retainer rails. The rails are most conveniently provided in lengths which do not exceed about 5 to 6 feet overall. Providing the retainer rails in these relatively short lengths makes them easier and less expensive to ship. The retainer rails each have a top surface, a bottom surface and oppositely arranged ends. The retainer rails have at least one seal channel formed so as to extend from a respective bottom surface thereof for receiving a length of a flexible elongate weather seal. They also have a separate extension channel formed in so as to extend from the respective bottom surfaces thereof for receiving an elongate retainer clip.

The retainer clip is which provided as a part of the knock-down seal assembly is selectively sized to be received within one of the extension channels provided on the bottom surface of each of two mating retainer rails. This allows two of the retainer rails to be assembled at a job site by installing a retainer clip in the extension channel provided in a first one of the retainer rails and then bringing a second one of the retainer rails into proximity with the first rail, so that the retainer clip fits within a pair of the retainer channels extending from the bottom surface of the first and second retainer rails when the channels are aligned. By using this assembly technique, two mating retainer rails are then joined together so that opposing ends of the respective retainer rails come into contact.

This allows two retainer rails to be joined having, for example, a resulting overall length in the range from about 16 to 20 feet, which is adequate for most standard garage doors. Because the original retainer rails are shipped in much shorter lengths, shipping costs are saved. It is also less likely that the shorter retainer rails will be damaged in shipment.

A distribution technique is also shown for distributing a weather seal assembly for an overhead door of the type previously described. The aforementioned component parts, i.e., the retainer rails, retainer clips and flexible weather seal materials, are shipped from a distribution center to an end use location. Once at an end use location, at least two of the retainer rails are joined together as previously described by installing a retainer clip in a selected extension channel provided on a bottom surface of a first one of the retainer rails and then bringing a second one of the retainer rails into proximity with the first rail, so that the retainer clip fits in a pair of aligned extension channels formed in the two retainer rails being joined and so that opposing ends of the respective retainer rails come into contact. A flexible elongate weather seal is then installed in one or more grooves provided on the bottom surface of the joined retainer rails. The assembled retainer rail can then be installed on the bottom lateral edge of an overhead door.

Additional objects, features and advantages will be apparent in the written description which follows.

DETAILED DESCRIPTION OF THE INVENTION

The preferred version of the invention presented in the following written description and the various features and advantageous details thereof are explained more fully with reference to the non-limiting examples included and as detailed in the description which follows. Descriptions of well-known components and processes and manufacturing techniques are omitted so as to not unnecessarily obscure the principal features of the invention as described herein. The examples used in the description which follows are intended merely to facilitate an understanding of ways in which the invention may be practiced and to further enable those skilled in the art to practice the invention. Accordingly, the examples should not be construed as limiting the scope of the claimed invention.

Figure 1:
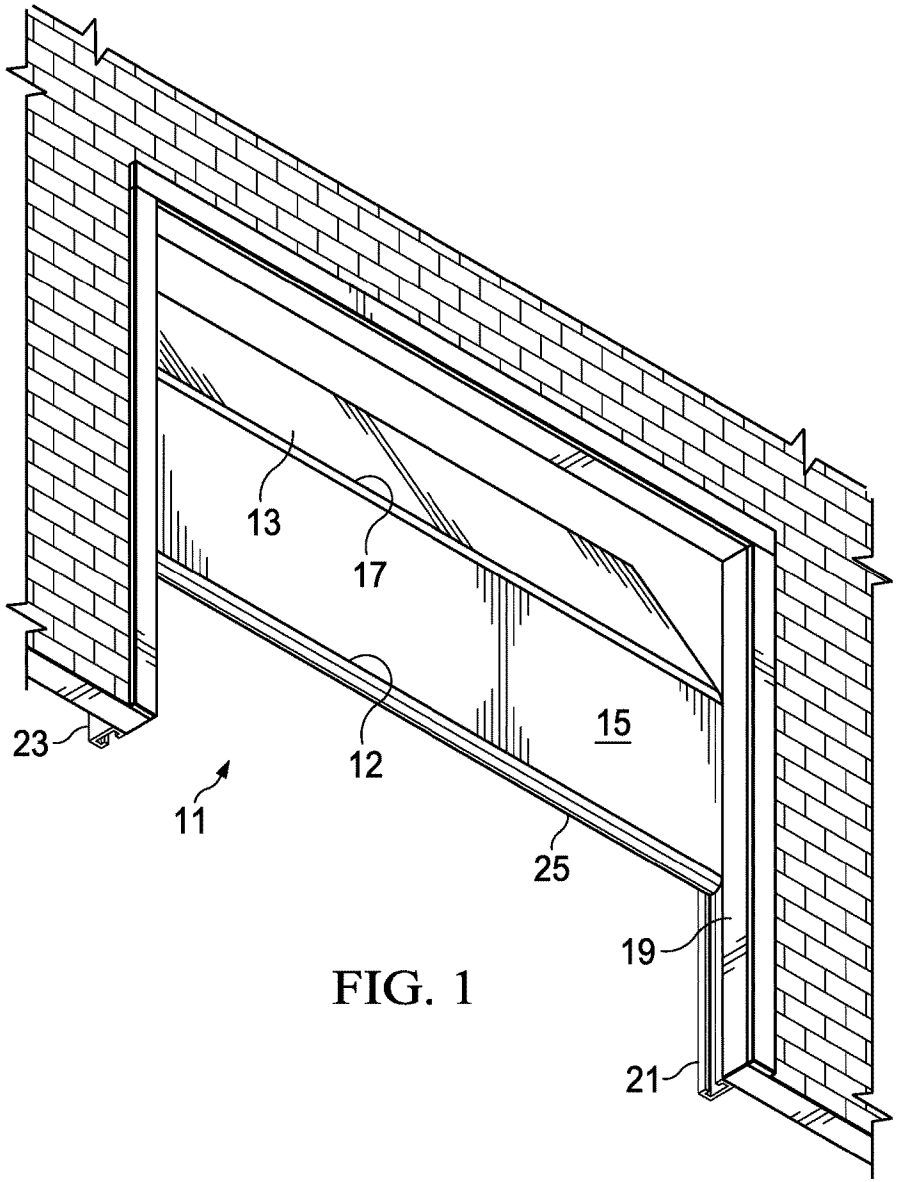
FIG. 1 is a perspective view of an overhead sectional garage door of the type which uses a bottom weather seal assembly along the bottom lateral edge of the door.

FIG. 1 is a simplified view of a section overhead door, referred to generally as 11. The overhead door 11 includes a series of door panels, such as panels 13, 15, that are interconnected along horizontal joints along hinge lines 17. As the door 11 opens or closes relative to a doorway 19, guide members, such as rollers (not shown), guide the movement of the panels along two lateral tracks 21, 23. The tracks 21, 23, may curve between horizontal and vertical, or assume other configurations. For example, the tracks may run generally linearly or only curve slightly, so that when the door opens, the door panels move above doorway 19, but remain in a generally vertical or slightly angled orientation, or they may be approximately horizontal when in the open position. To close door 11, the vertical sections of tracks 21, 23, guide the panels from a horizontal position to a vertical position across doorway 19. The overhead door 11 will also be typically provided with a weather seal strip (designated 25 in FIG. 1) which runs along a bottom lateral edge 12 of the door 11. This seal strip provides a seal between a leading edge of panel 15 and a floor or traffic surface below the doorway. The weather seal also ensures that the bottom of the door is level to the floor when closed.

The actual structure of panels 13, 15, of the overhead door can vary. For example, at least the lowermost panel 15 could be made of a material which has enough flexibility to recover from a vehicle impact, as it is the lowermost panel that is most susceptible to being struck. Thus, in some embodiments, the lowermost panel 15 can comprise a foam core whose outer faces are each bonded to a tough face panel that is generally harder than foam core. The foam core provides a lightweight panel that provides thermal insulation and a desirable balance of rigidity and flexibility, while face panels offer resistance to wear, weather, and impact. Some preferred materials include polyethylene foam for the core and an ABS or PVC acrylic for face panels. However, it will be understood by those skilled in the relevant arts that a wide variety of other materials could also be used. For example, any of the door panels, such as panels 13, 15, could be formed of sheet metal or aluminum, or even of wood.

The bottom weather seal strip 25 can conveniently be either a "bulb seal" or a "blade seal", as will be familiar to those skilled in the art. The bulb seal is essentially a closed seal in the sense that it is secured to the frame component along its longitudinal edges. The bulb seal can be manufactured from a relatively soft and resilient material, such as a suitable rubber or other synthetic that can be compressed to form a seal when the door is closed and that at least partially rebounds when the door is opened. The blade type seal might be formed of a suitable plastic, such as a suitable vinyl plastic.

Figure 2:
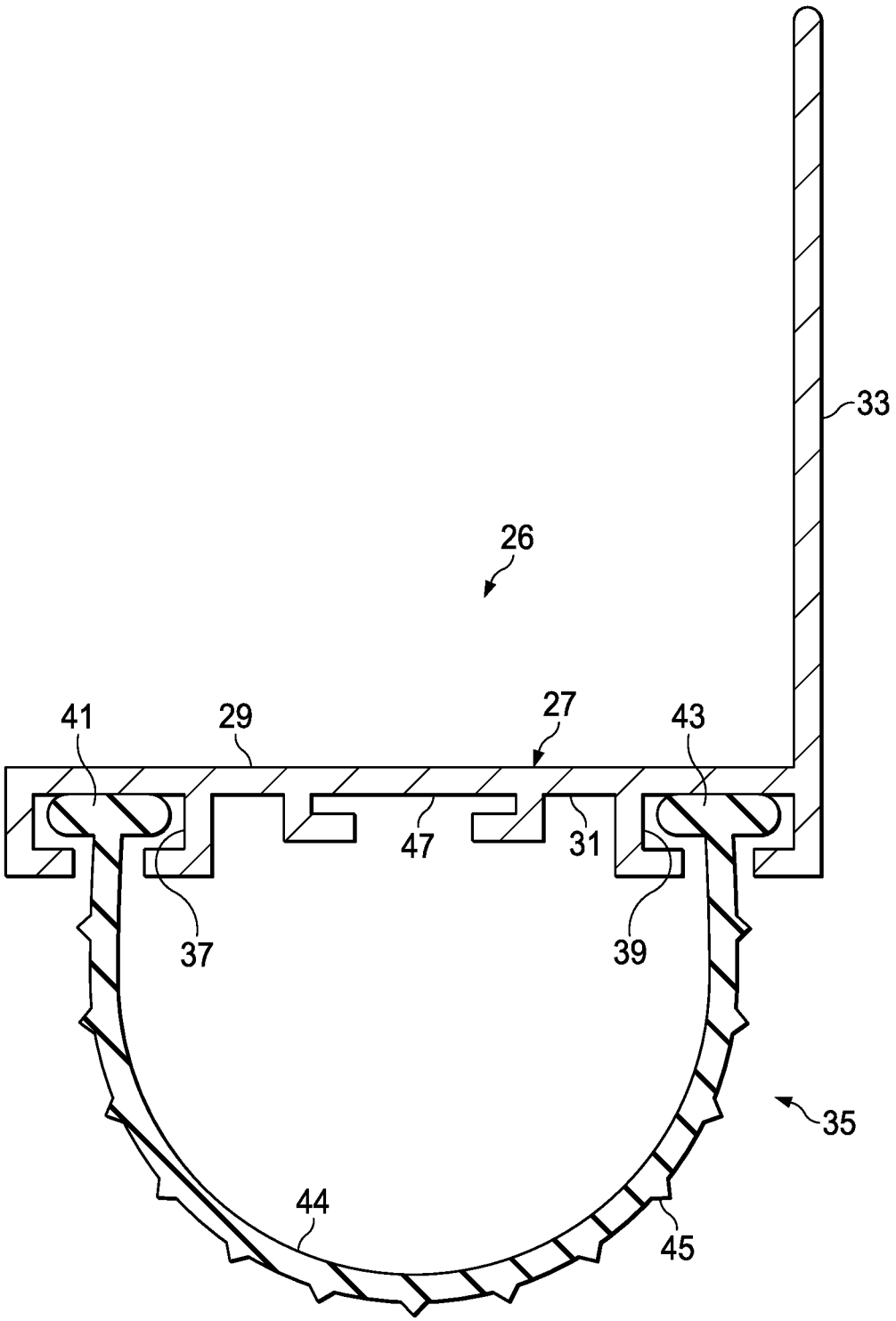
FIG. 2 is a side view of the weather seal retainer assembly of the invention.

FIG. 2 shows a weather seal assembly which incorporates certain of the features of the invention. The weather seal assembly shown in FIG. 2 uses a modified version of Applicant's "Aluminum or Plastic Weather Seal Retainer" sold commercially by National Door Industries, Inc., of Fort Worth, Tex. The Aluminum Weather Seal Retainer Rail is used as a bottom retainer on ship lap or tongue and groove doors. It can be installed with screws, nails or rivets. The Plastic Weather Seal Retainer Rails are commonly used as a bottom retainer rail on 2 inch doors. The available "Style F" has a flat bottom for wood or steel doors while the "Style T" is for tongue and grooved doors. These retainer rails can be conveniently extruded aluminum or vinyl plastic, or the like.

The weather seal assembly shown in FIG. 2 is generally a "Type F" retainer rail 26 having a base region 27 with a top surface 29 and a bottom surface 31. The base region 27 is joined to an upright region 33. Both the base region 27 and the upright region 33 run longitudinally along the bottom lateral edge (12 in FIG. 1) of the overhead door when installed. Since the retainer rail spans the entire width of the door opening 19, it was generally necessary in the past to provide the rails in relatively longer lengths, such as, for example, 16 to 20 feet lengths. As has been explained, this could cause problems in shipping the rails and also added to the cost of shipping. As will be explained more fully, the modified retainer rails of the invention allow the rails to be provided in relatively shorter lengths, for example, 5 or 6 foot lengths. Such lengths can usually be shipped by commercial carrier without incurring additional excess shipping charges.

Referring back to FIG. 2, the weather seal assembly of the invention is thus provided with at least two retainer rails such as the rail shown. As with the traditional extruded rails, the rail in FIG. 2 has at least one seal channel formed so as to extend from the bottom surface 31 thereof for receiving one of the flexible elongate weather seals such as the seal 35 shown. Preferably, a pair of seal channels 37, 39, are formed in spaced-apart fashion so as to extend from the bottom surface 31 and run for substantially the length of the bottom surface 31, They are adapted to slidingly receive the tab portions 41, 43, of the weather seal element 35, thereby forming the bulb-shaped region 44. In the example shown in FIG. 2, the weather seal strip 35 also has external ribs 45 running along the exterior thereof.

Figure 3A:
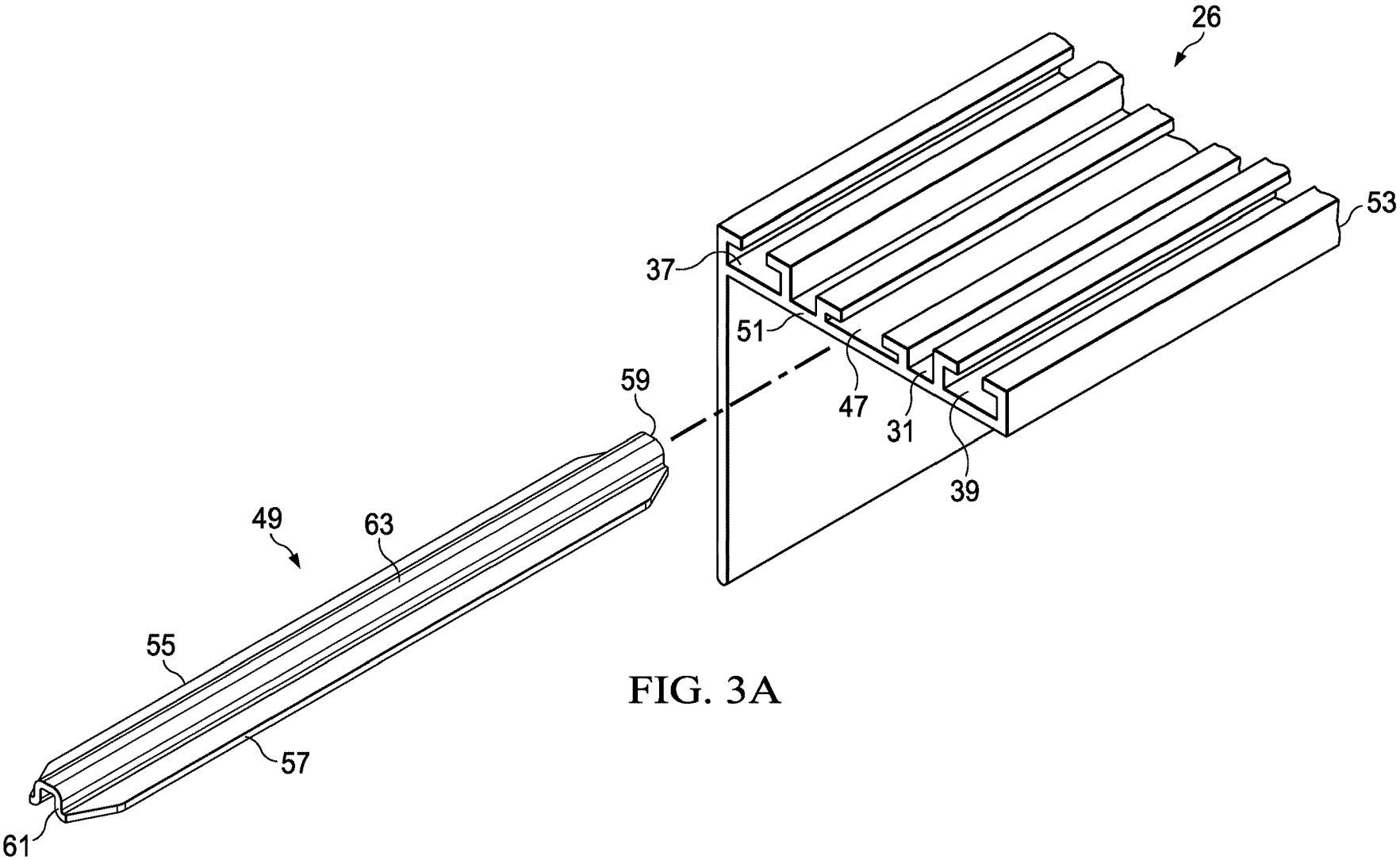
FIG. 3A is an isolated, perspective view of a portion of one of the retainer rails of the invention with the associated retainer clip being shown in exploded fashion, prior to assembly.

The weather seal assembly of FIG. 2 differs from the prior art in also having an additional elongate extension channel 47, formed at the time the retainer rail was extruded so as to extend from the bottom surface 31 of the retailer rail. The extension channel 47 is adapted to receive an elongate retainer clip, shown as 49 in FIG. 3A. As shown in FIG. 3A, the extension channel is located approximately mid-way between the seal channels 37, 39, on the bottom surface of the retainer rails 26. The extension groove has a length which is defined between a pair of opposing ends of the respective retainer rails, such as the ends 51, 53, shown in the broken off portion of the extension rail 26.

Figure 3B:
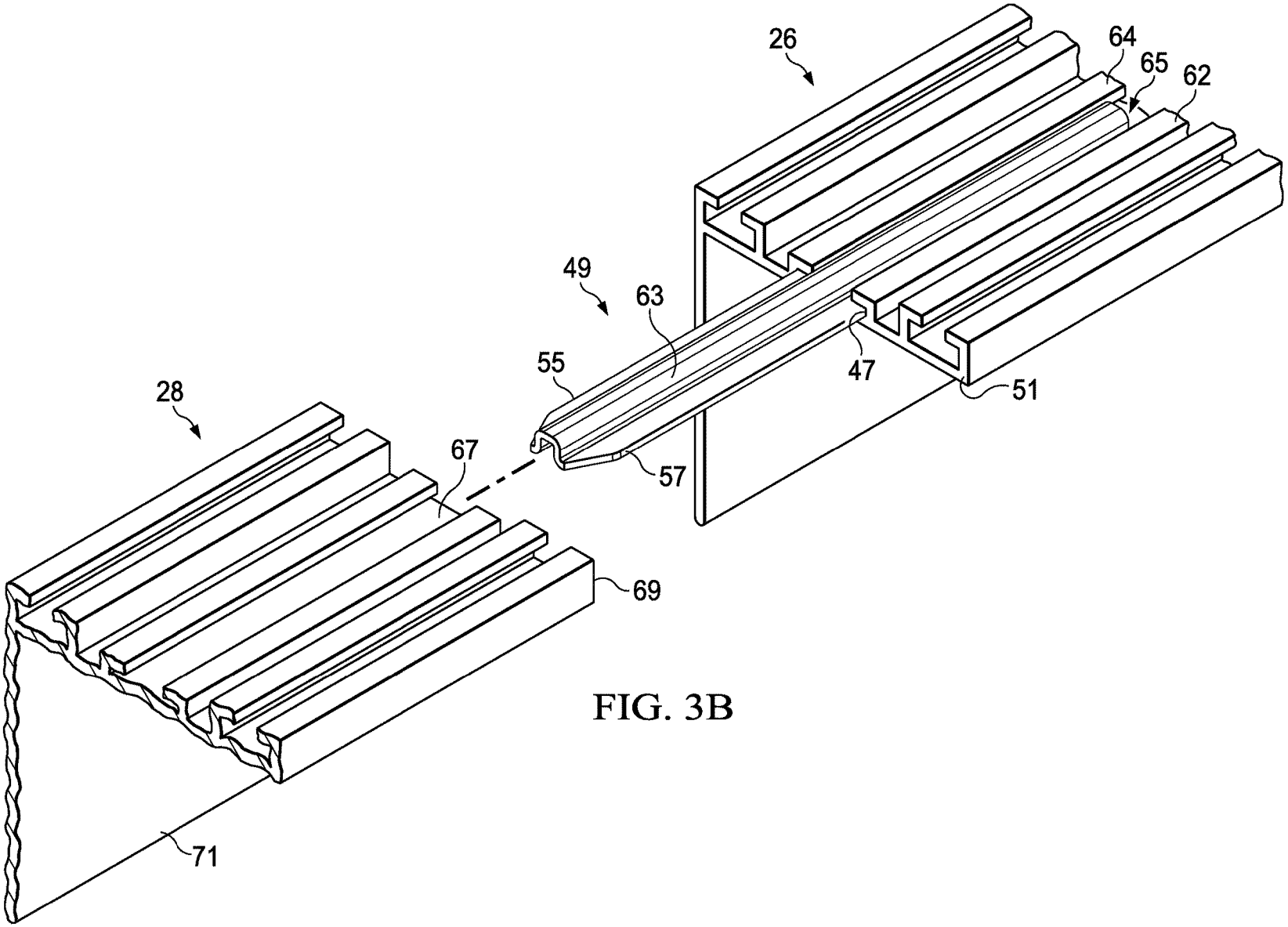
FIG. 3B is a view similar to FIG. 3A, but showing a pair of the retainer rails with the retainer clip in place on one of the rails prior to assembly with the second rail.

The retainer clip (49 in FIG. 3A) used in the practice of the invention is selectively sized to be received within a selected extension channel (such as channel 47) provided on the bottom surface 31 of each of two mating retainer rails, such as the two retainer rails 26, 28, shown in FIG. 3B. It is conveniently friction fit within the selected extension channel. The preferred retainer clip 49 shown in FIG. 3A is an elongate element which in the example shown is about 8 to 20 inches long and which has opposing side rail surfaces 55, 57, opposing end surfaces 59, 61, and a central raised tunnel region 63.

As perhaps best seen in FIG. 3B, the retainer clip 49 is used to join a first retainer rail 26 to a second retainer rail 28 by first inserting one end of the retainer clip 49 into the extension channel 47 extending from the bottom surface of the retainer rail 26. The opposing side rail surfaces 55, 57, lit snugly in the extension channel 47 being captured by the ear regions 62, 64, of the extension channel 47, while the central tunnel region 63 of the retainer clip occupies the upwardly facing opening (generally at 65 in FIG. 3B).

Figure 3C:
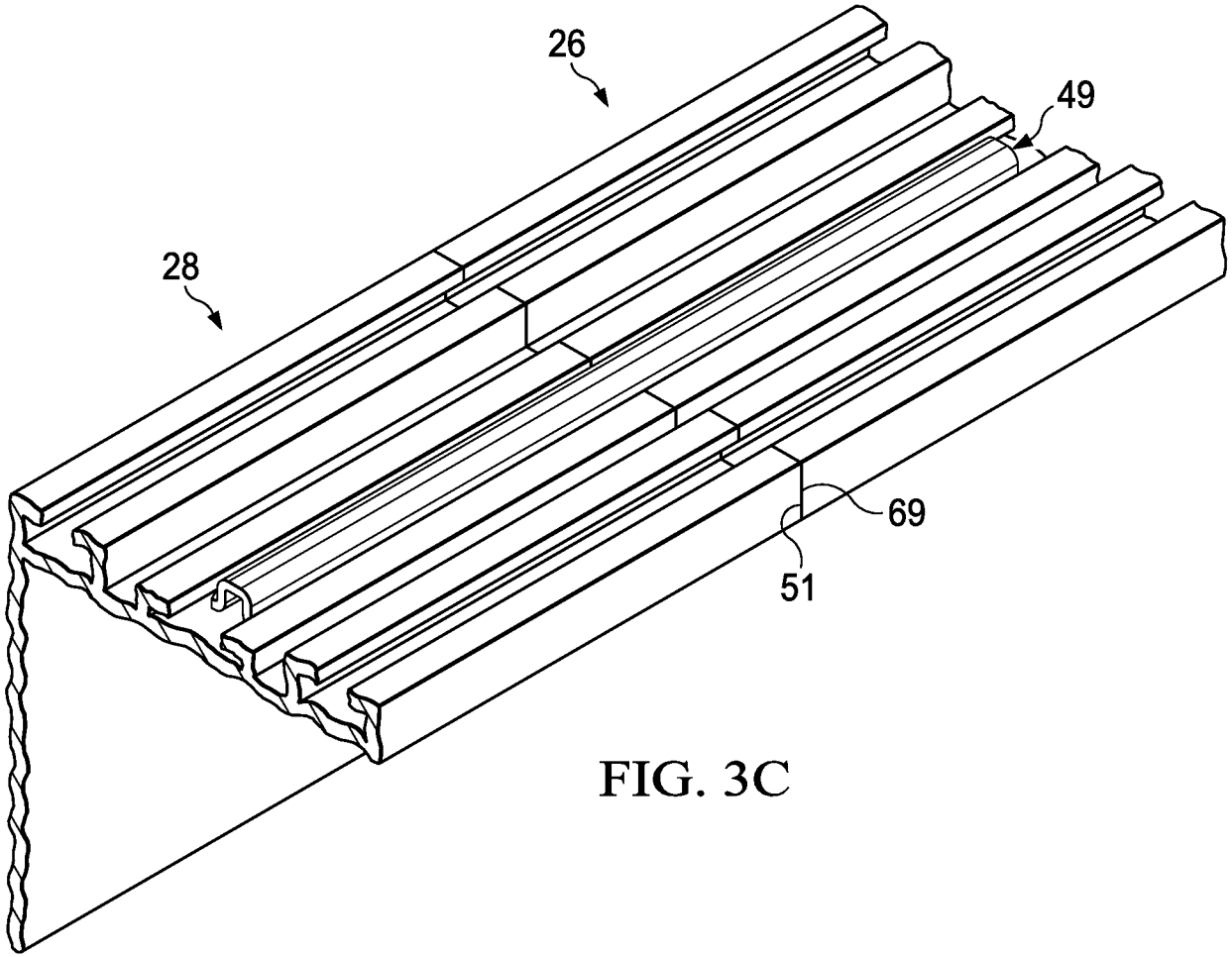
FIG. 3C is a perspective view of a pair of the weather seal retainer rails with the rails being shown joined together with the retainer clip of the invention.

As illustrated in FIGS. 38 and 3C, the two retainer rails 26, 28, can be then assembled at a job site by installing the retainer clip 49 in the extension channel 47 provided in a first one of the retainer rails 26 and then bringing a second one 28 of the retainer rails into proximity with the first rail, so that the retainer clip 49 fits in a pair of aligned extension channels (such as channels 47 and 67 shown in FIG. 3B) extending from the bottom surface of the retainer rails when the channels are aligned. Bringing the two rails 26, 28, together then joins the rails so that the opposing ends 51, 69, of the respective retainer rails conic into contact. This allows an extension rail to be assembled of a greater overall length, for example, resulting overall length in the range from about 16 to 20 feet. More than two extension rails could also be assembled in the same fashion.

The extension clips are generally only needed to hold the two extension rail sections together firmly until they can be installed on the bottom edge of the overhead door. Thus, convenient regions, such as region 71 shown in FIG. 3B, may be provided with apertures, such as screw holes or slots, for securing the retainer rails to the door. The screw holes or slots may be disposed on essentially any portion of the frame components, however. Alternatively, one or both of the frame components may be manufactured with a groove and/or with indentations that provide a guide for forming screw holes during installation.

It will also be appreciated from the foregoing discussion that an improved distribution technique is also shown for distributing a weather seal assembly of the type previously described. The aforementioned component parts, i.e., the retainer rails, retainer clips and flexible weather seal materials, are shipped from a distribution center to an end use location. Once at an end use location, at least two of the retainer rails are joined together as previously described using the retainer clips and retainer channels. The result is a single retainer rail of a relatively longer overall length, say 16 feet for a typical garage door. A flexible elongate weather seal can then be installed in one or more grooves provided on the bottom surface of the joined retainer rails. The assembled retainer rail can then be installed on the bottom lateral edge of an overhead door. Alternatively, the retainer rail could be installed on the garage door first, followed by installing the weather seal material.

An invention has been provided with several advantages. The knock-down weather seal assembly of the invention provides a simple and money saving solution to the problem of shipping longer length weather seal retainer rails. The knock-down nature of the product allows an end user to assemble two or more shorter lengths of retainer rail into one longer overall assembly at a job site or other location. In addition to saving shipping costs, the distribution method of the invention also lessens the probability that product will be damaged during shipment.

While the invention has been shown in only one of its forms, it will be appreciated that it is not thus limited, but is susceptible to various changes and modifications without departing from the spirit thereof.

What is claimed is:

1. A method of distributing a weather seal assembly for an overhead door, the door having a bottom lateral edge, the method comprising the steps of:

providing first and second retainer rails, the first and second retainer rails each having an overall length which does not exceed 6 feet, each of the first and second retainer rails having seal channels formed so as to extend from a bottom surface thereof for receiving end of a flexible elongate weather seal, each of the first and second retainer rails also having an extension channel formed so as to extend from the bottom surface thereof for receiving an elongate retainer clip, the bottom surface of each of the retainer rails being defined between a pair of opposing ends of the retainer rail;

shipping the first and second retainer rails, the elongate retainer clip and the flexible elongate weather seal from a distribution center to an end use location;

joining the first and second retainer rails together to form a pair of joined retainer rails by installing a first portion of the elongate retainer clip in the extension channel of the first retainer rail and then installing a second portion of the elongate retainer clip in the extension channel of the second retainer rail so that the first and second retainer rails come into contact;

installing the flexible elongate weather seal within the seal channels of each of the retainer rails;

installing the pair of joined retainer rails and flexible elongate weather seal on the bottom lateral edge of the overhead door; and wherein the elongate retainer clip is friction fit within the extension channels, the elongate retainer clip having opposing side rails and a central raised tunnel region, the extension channels each having ear regions which capture the side rails of the elongate retainer clip, each of the extension channels also having an opening defined between the ear regions which receives the central tunnel region of the elongate retainer clip.

2. The method of claim 1, wherein the retainer rails are formed of extruded aluminum.

3. The method of claim 1, wherein the retainer rails are formed of a plastic material.

4. The method of claim 1, wherein the weather seal is a bulb type seal.

5. A method of distributing a weather seal assembly for an overhead garage door, the door being a sectional door having a series of hinged panels interconnected along horizontal joints and having a bottom lateral edge, the method comprising the steps of:

providing first and second retainer rails, the first and second retainer rails each having an overall length which does not exceed 6 feet, each of the first and second retainer rails having seal channels formed so as to extend from a bottom surface thereof for receiving ends of a flexible elongate weather seal, each of the first and second retainer rails also having an extension channel formed so as to extend from the bottom surface thereof for receiving an elongate retainer clip, the bottom surface each of the retainer rails being defined between a pair of opposing ends of the retainer rail;

packaging a weather seal assembly kit which includes the two retainer rails, the elongate retainer clip and the weather seal;

shipping the weather seal assembly kit from a distribution center to an end use location;

joining the first and second retainer rails together to form a pair of joined retainer rails by installing a first portion of the elongate retainer clip in the extension channel of the first retainer rails and then installing a second portion of the elongate retainer clip in the extension channel of the second retainer rail so that the first and second retainer rails come into contact and are joined together;

installing the joined retainer rails on the bottom lateral edge of the overhead door; and wherein the elongate retainer clip is friction fit within the extension channels, the elongate retainer clip having opposing side rails and a central raised tunnel region, the extension channels each having ear regions which capture the side rails of the elongate retainer clip, each of the extension channels also having an opening defined between the ear regions which receives the central tunnel region of the elongate retainer clip.

6. The method of claim 5, wherein once joined, the first and second retainer rails have a resulting overall length of at least 12 feet.

* * * * *